United States Patent [19]

Vogel et al.

[11] Patent Number: 4,998,501

[45] Date of Patent: Mar. 12, 1991

[54] TWIN VELOCITY LOCALIZED COLLECTION HEAD

[75] Inventors: James C. Vogel; Christopher R. Merritt, both of Indianapolis, Ind.

[73] Assignee: Ransburg Corporation, Indianapolis, Ind.

[21] Appl. No.: 455,451

[22] PCT Filed: Oct. 13, 1988

[86] PCT No.: PCT/US88/03562

§ 371 Date: Nov. 13, 1989

§ 102(e) Date: Nov. 13, 1989

[87] PCT Pub. No.: WO89/04882

PCT Pub. Date: Jun. 1, 1989

[51] Int. Cl.[5] ..... B05C 3/09; B05B 15/04

[52] U.S. Cl. ..... 118/312; 118/326

[58] Field of Search ..... 118/DIG. 1, 61, 621, 118/629, 630, 631, 302, 308, 313, 314, 315, 316, 326, 312, 602, 310, 634; 98/36, 115.1, 115.2

[56] References Cited

U.S. PATENT DOCUMENTS

| | | | |
|---|---|---|---|
| 3,270,711 | 9/1966 | Leach | 118/627 |
| 4,024,815 | 5/1977 | Platsch | 118/DIG. 1 |
| 4,241,646 | 12/1980 | Tsuruta et al. | 118/326 |
| 4,277,260 | 7/1981 | Browning | 118/326 |
| 4,375,487 | 3/1983 | Huber | 98/115.2 |
| 4,664,061 | 5/1987 | Morioka et al. | 118/663 |

*Primary Examiner*—Willard E. Hoag

*Attorney, Agent, or Firm*—Barnes & Thornburg

[57] ABSTRACT

Apparatus for applying a fusible granular precursor of a protective and/or decorative coating to the surface of an article. The apparatus includes a dispenser for dispensing a stream of the fusible granular precursor in a stream of a bearing fluid, a recovery mechanism for recovering fusible granular precursor that does not adhere to the surface of the article, and mounting hardware for mounting the dispenser within the recovery mechanism. The recovery mechanism is coupled to a reclaim facility for reclaiming fusible granular precursor recovered by the recovery mechanism. The recovery mechanism includes first and second manifolds, a blower for establishing subambient pressures in the first and second manifolds, a first series of inlets generally surrounding the dispenser and coupled to the first manifold, and a second series of inlets coupled to the second manifold.

15 Claims, 3 Drawing Sheets

TWIN VELOCITY LOCALIZED COLLECTION HEAD

This is a continuation of application Ser. No. 07/125,372, filed Nov. 25, 1987 and now abandoned.

This invention relates to apparatus for coating articles with decorative and protective coatings, such as paints and powder coatings. It is disclosed in the context of a powder collector. However, it is believed that the invention will find utility in other environments as well.

The protective abilities of fused powder coatings are well known. While protective and decorative powder coatings have been applied to articles for some time, it is in the nature of the presently known powder coating processes that it is difficult to control where powder is applied to the surface of an article. Thus, powder coating has not been a viable technology where only certain zones of an article which passes through a powder coating booth need to be, or are desired to be, coated. Let it be assumed, for example, that it is desired to powder coat only the lower regions of a vehicle body, for example, the lower one-third to one-fourth of the body, all of the way around the vehicle, to protect the vehicle body metal from rusting due to chips caused by flying stones and the like, which chips would ex tend entirely through the protective and decorative coating of the vehicle body and expose bare metal. One way to reduce substantially the likelihood of such exposure would be to coat the lower one-third to one-fourth of the vehicle body with a powdered material which, when fused, forms a highly resilient and durable protective layer around the lower one-third to one-fourth of the body. Such powders are well known in the industry. Heretofore, however, the technology for applying such powders in a reasonably controlled fashion only to the lower one-third to one-fourth of the vehicle body has not been available. It is proposed hereby to provide an apparatus for the controlled application of fluid-borne powders only to certain zones of an article for fusing into protective and/or decorative coatings on those zones.

According to the invention, apparatus for applying a fusible granular precursor of a protective and/or decorative coating to the surface of an article comprises means for dispensing a stream of the fusible granular precursor in a stream of a bearing fluid, means for recovering fusible granular precursor that does not adhere to the surface of the article, means for mounting the dispensing means within the recovery means and means for coupling the recovery means to means for reclaiming fusible granular precursor recovered by the recovering means. The recovering means includes a first manifold, means for establishing in the first manifold a subambient pressure, a second manifold, and means for establishing in the second manifold a subambient pressure. The apparatus further includes means providing a first series of inlets generally surrounding the dispensing means, means for coupling the inlets of the first series to the first manifold, means providing a second series of inlets, and means for coupling the inlets of the second series to the second manifold.

Illustratively according to the invention, the means for coupling the inlets of the first series to the first manifold comprises a independently controllable damper for controlling flow through each inlet of the first series.

Additionally according to the invention, the means for coupling the inlets of the second series to the second manifold illustratively comprises an independently controllable damper for controlling flow through each inlet of the second series.

Illustratively, apparatus according to the invention comprises a fusible granular precursor deflection shield, means for movably mounting the deflection shield adjacent the dispensing means, and means for selectively moving the deflection shield between a use orientation in which the shield deflects fusible granular precursor dispensed by the dispensing means primarily into one of the inlets of the second series and a storage orientation in which the shield lies between the dispensing means and said one of the inlets of the second series.

Illustratively, apparatus according to the invention further comprises second means for dispensing a stream of fusible granular precursor in a stream of a bearing fluid, means for mounting the second dispensing means within the recovery means, a second fusible granular precursor deflection shield, means for movably mounting the second deflection shield adjacent the second dispensing means, and means for selectively moving the second deflection shield between a use orientation in which the second deflection shield deflects fusible granular precursor dispensed by the second dispensing means primarily into a second one of the inlets of the second series and a storage orientation in which the second shield lies between the second dispensing means and said second one of the inlets of the second series.

The invention may best be understood by referring to the following description and accompanying drawings which illustrate the invention.

BRIEF DESCRIPTION OF THE DRAWINGS

Referring now to FIGS. 1-2, automotive vehicle bodies 20 are serially conveyed along a conveyor 22. Conveyor 22 conveys them past a powder coating station 42 including a powder coating- and excess powder recovery-head 44 disposed on each side of the conveyor 22. Only one of these heads 44 is illustrated, but it will immediately be appreciated that a head 44 will be required on each side of conveyor 22 to powder coat the lower regions of both sides 40 of each body 20. Since bodies 20 having different body widths and contours can be conveyed along conveyor 22, mechanisms can be provided to reciprocate heads 44 toward and away from each other as indicated by double ended arrow 46 in FIG. 2. This mechanism can include a wheeled cart 48 for each head 44, and some means (not shown) to power the reciprocation, such as hydraulic piston-and-cylinder motors or pneumatic piston-and-cylinder motors. These can be controlled by a programmable machine which keeps track of the location along conveyor 22 of each body 20. The machine will thus be able to calculate the timing of any body 20's passage between heads 44 and insure the appropriate spacing between heads 44 to accommodate that body 20's width.

Figure 1:
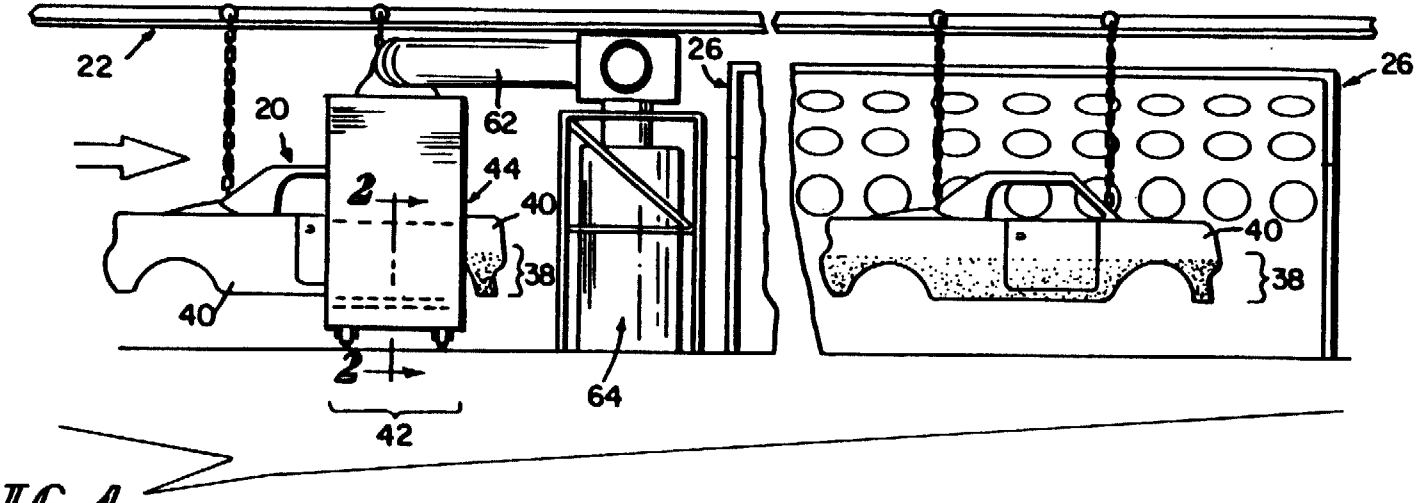
FIG. 1 illustrates schematically a longitudinally sectional side elevational view of a powder coating and excess powder recovery installation and a conveyor for conveying articles, illustratively automotive vehicle bodies, through the powder coating installation.
Figure 2:
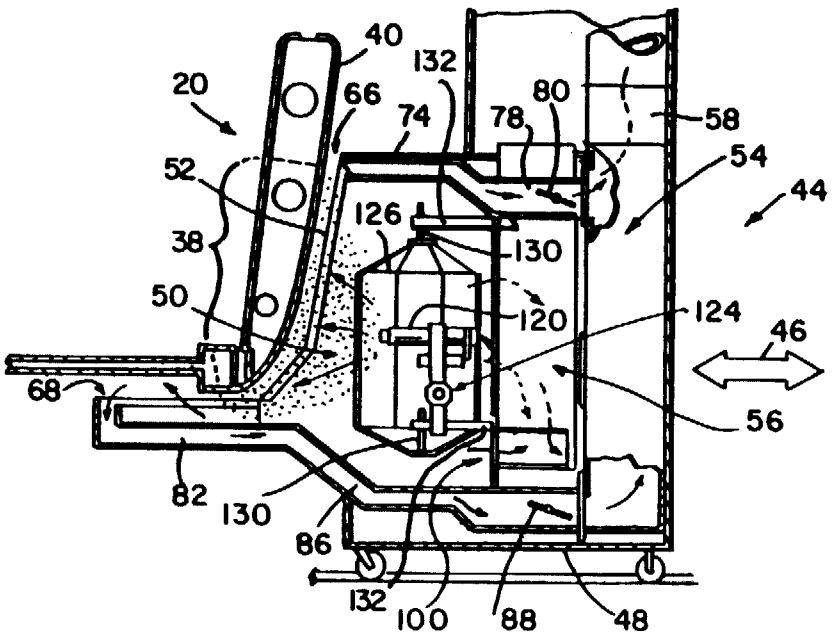
FIG. 2 illustrates a fragmentary sectional view, taken generally along section lines 2—2 of FIG. 1.

Turning now specifically to a discussion of the details of construction of each head 44, it will be appreciated from FIG. 2 that head 44 includes a mouth region 50 which opens toward conveyor 22 and, surrounding mouth 50, a lip region 52 which is shaped to project into closely spaced orientation to the lower one-third to one-fourth of the side 40 of a vehicle 20 to be coated. If the side contours of different vehicles 20 conveyed along conveyor 22 are radically different, multiple stations, each equipped with two opposed heads 44 having different lip 52 contours can be provided serially.

Referring now to FIGS. 2-7, each head 44 includes a first manifold 54 and a second manifold 56. Manifolds 54, 56 are coupled through ducts 58, 60, respectively, to a single extractor duct 62, which in turn is coup led to a powder separator 64 of known configuration. Dampers 59, 61 can be provided in ducts 58, 60, respectively. A group 66, 68, 70, 72 of first inlets are provided at lip 52. Inlet 66 lies above mouth 50, inlet 68 generally below mouth 50, inlet 70 to the left of mouth 50 as viewed from the conveyor 22 side of head 44, and inlet 72 to the right of mouth 50.

Figure 4:
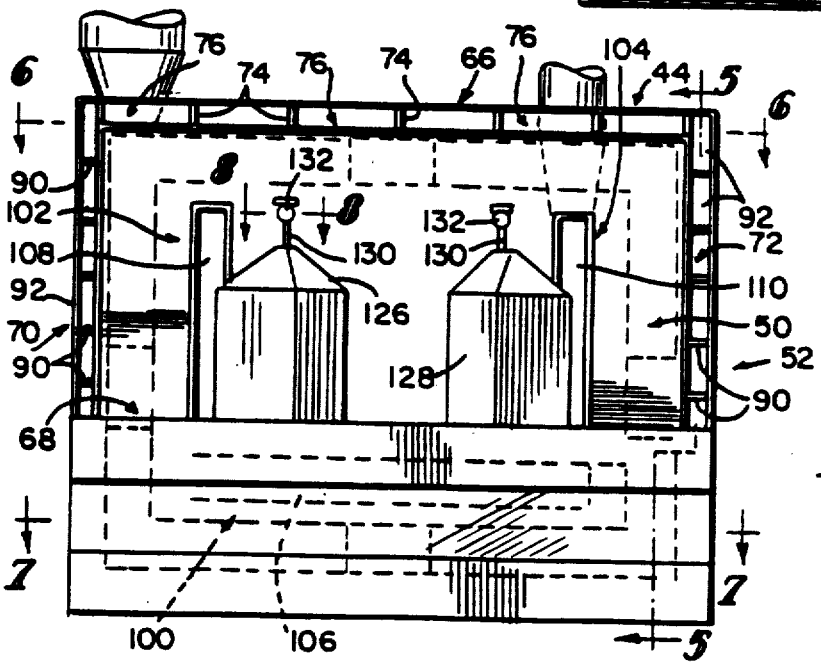
FIG. 4 illustrates a front elevational view of the apparatus of FIGS. 2-3.
Figure 6:
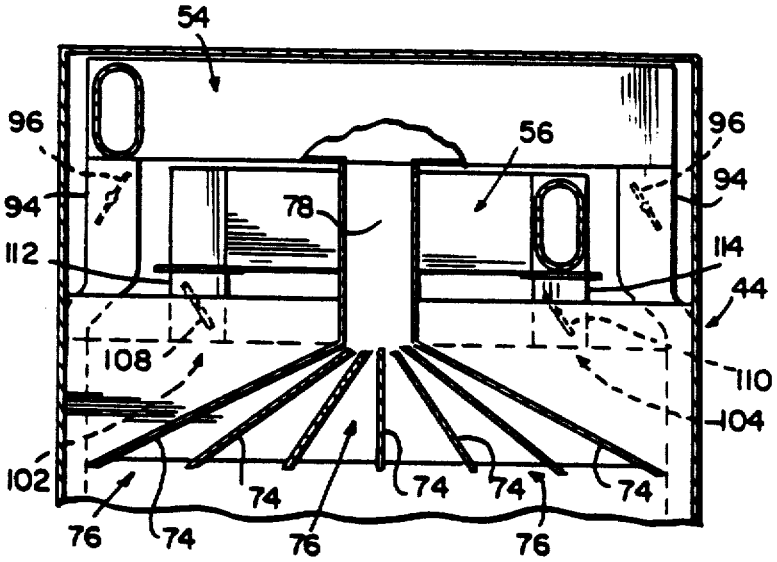
FIG. 6 illustrates a fragmentary sectional view of the apparatus of FIGS. 2-5, taken generally along section lines 6—6 of FIG. 4.

As best illustrated in FIGS. 4 and 6, inlet 66 is subdivided by a plurality of baffles 74 which divide inlet 66 into multiple, generally equal frontal area openings 76. Baffles 74 extend straight rearwardly, terminating at a connecting duct 78. Connecting duct 78 connects inlet 66 to manifold 54. Baffles 74 also divide the opening of inlet 66 into generally equal area openings into connecting duct 78. As best illustrated in FIG. 2, duct 78 is provided with an independently controllable damper 80.

Figure 7:
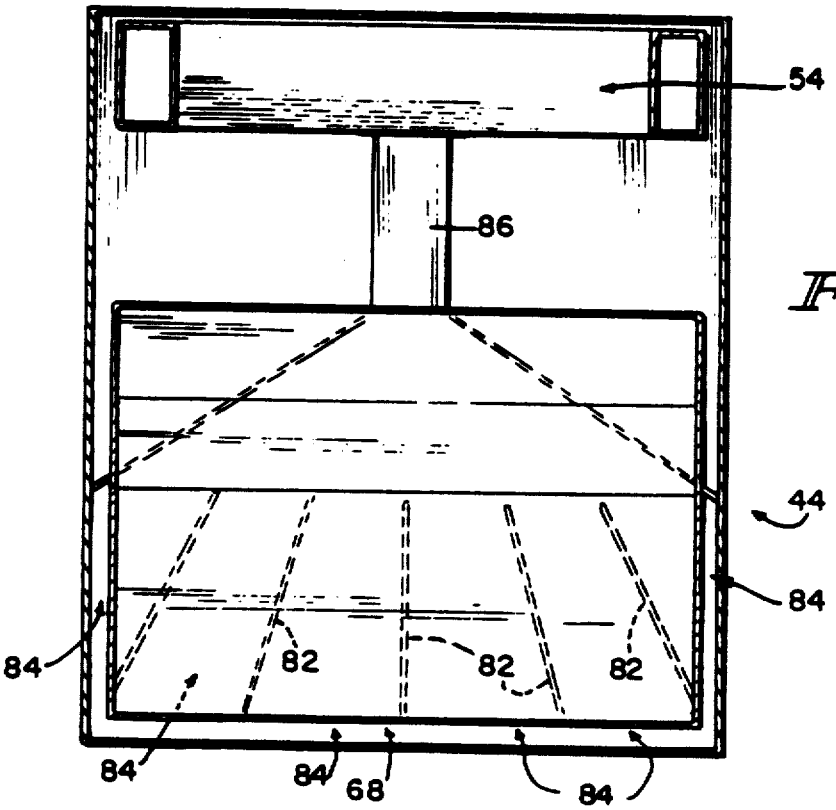
FIG. 7 illustrates a fragmentary sectional view of the apparatus of FIGS. 2-6, taken generally along section lines 7—7 of FIG. 4.

As best illustrated in FIG. 7, inlet 68 is subdivided by a plurality of baffles 82 which divide inlet 68 into multiple, generally equal frontal area openings 84. Baffles 82 extend straight rearwardly, terminating before a connecting duct 86. Connecting duct 86 connects inlet 68 to manifold 54. Baffles 82 also divide the opening of inlet 68 into generally equal area openings into connecting duct 86. As best illustrated in FIG. 2, duct 86 is provided with an independently controllable damper 88.

Figure 5:
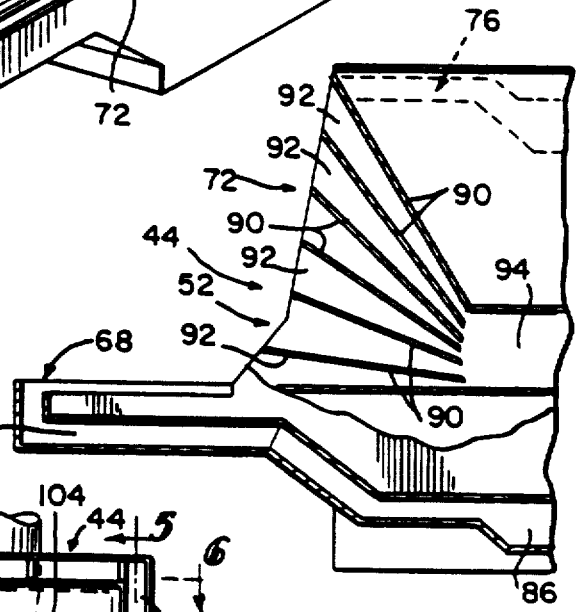
FIG. 5 illustrates a fragmentary sectional view of the apparatus of FIGS. 2-4, taken generally along section lines 5—5 of FIG. 4.

As best illustrated in FIGS. 4 and 5, each of inlets 70, 72 is subdivided by a plurality of baffles 90 which divide the inlet 70, 72 into multiple, generally equal frontal area openings 92. Baffles 90 extend straight rearwardly, terminating at a connecting duct 94. Connecting ducts 94 connect each side inlet 70, 72 to manifold 54. Baffles 90 also divide the opening of each inlet 70, 72 into generally equal area openings into connecting duct 94. As best illustrated in FIG. 6, each duct 94 is provided with an independently controllable damper 96.

A group 100, 102, 104 of second inlets is provided inside mouth 50. Inlet 100 lies generally adjacent the floor of mouth 50, inlet 102 to the left side of mouth 50 as viewed from the conveyor 22 side of head 44, and inlet 104 to the right side of mouth 50. Each of inlets 100, 102, 104 is generally slot-shaped, with the longer dimension of inlet 100 extending generally parallel to the direction of motion of bodies 20 along conveyor 22 and opening toward sides 40 of bodies 20 as the bodies 20 pass the head 44. The longer dimensions of inlets 102, 104 extend generally vertically. These inlets also open toward sides 40 of bodies 20 as the bodies 20 pass the head 44. Separate, independently controllable dampers 106 (seen only in broken lines in FIG. 4), 108, 110 (both best seen in broken lines in FIG. 6), respectively, are provided in inlet 100 and in connecting ducts 112, 114 by which inlets 102, 104, respectively, are connected to manifold 56.

Figure 3:
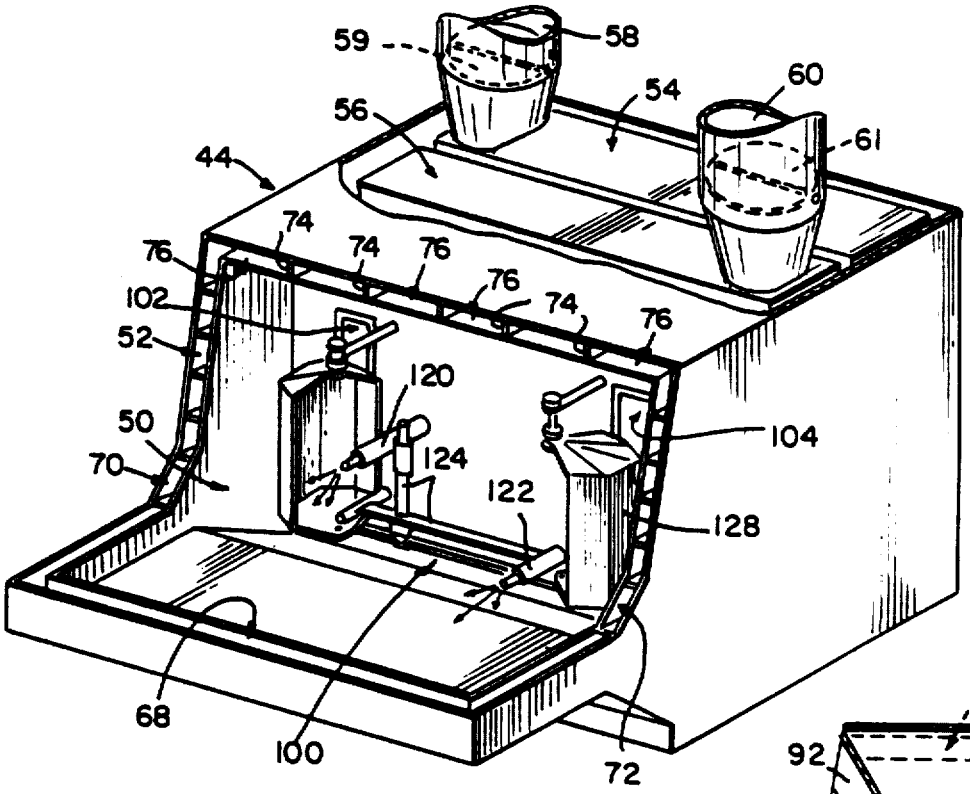
FIG. 3 illustrates a perspective view, partly broken away, of the apparatus of FIG. 2.

As best illustrated in FIGS. 2-3, two vertically and horizontally spaced apart powder dispensing guns 120, 122 are mounted from a rigid supporting- and powder supply tubing-framework 124. Guns 120, 122 illustratively are Ransburg GEMA Model AP-801 powder guns, available through Ransburg GEMA, 3939 West 56the Street, Indianapolis, Ind. 46254-1597. The tubing framework 124 supplies guns 120, 122 with the appropriate powder entrained in an appropriate carrier fluid stream, such as compressed air, from a suitable source such as a fluidized powder bed. These devices are known in the art and need not be further described here. Guns 120, 122 are typically coupled to one terminal of a suitable electrostatic power supply (not shown), the other terminal of which is coupled to bodies 20, illustratively through electrically conductive components of conveyor 22.

Figure 8:
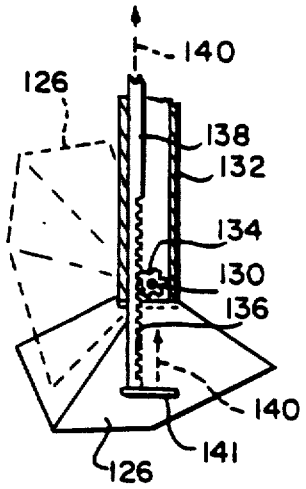
FIG. 8 illustrates a fragmentary sectional view of the apparatus of FIGS. 2-7, taken generally along section lines 8—8 of FIG. 4.

Powder deflecting shields 126, 128 are mounted adjacent guns 120, 122, respectively. The shields 126, 128 are independently movable between non-use, or storage, orientations illustrated in FIGS. 2-3, and powder deflecting, or use, orientations, illustrated in FIG. 6. An illustrative mechanism for moving each shield 126, 128 between these orientations is a rotary actuator of the type available from, for example, Flo-Tork, Inc., 1701 North Main Street, P.O. Box 68, Orrville, Ohio 44667-0068. An alternative mechanism for rotating shields 126, 128 is best illustrated in FIG. 8. Each shield is mounted on a generally vertically extending pivot axis 130 from two generally circular transverse section tubular framework members 132 and is journalled for rotation with respect to respective framework members 132. Each pivot axis 130 is provided with a pinion gear 134 within a respective vertically upper framework member 132. A rack 136 is provided on one side of an operating rod 138 which may be, for example, associated with the piston or cylinder of an independently actuable pneumatic- or hydraulic-fluid piston-and-cylinder motor, not shown. Protraction of operating rod 138 rotates the respective shield 126, 128 to its use orientation illustrated in solid lines in FIG. 8. Retraction of the rod 138 in the direction indicated by broken line arrows 140 in FIG. 8 rotates the respective shield 126, 128 to its storage orientation illustrated in broken lines in FIG. 8. The forward end of each rod 138 is provided with an end cap 141 for closing the end of its respective framework member 132, reducing the opportunity for dispensed powder to enter and foul the rack and pinion mechanism 134, 138 and the fluid motor which operates it.

The dampers 59, 61, 80, 88, 96, 106, 108, 110 are so adjusted during operation that relatively low velocity, non-turbulent scavenging of powder-laden air is achieved through inlets 100, 102, 104, while substantially higher velocity scavenging is achieved through inlets 66, 68, 70, 72. It is believed that the powder recovery system should not be so adjusted, in terms of scavenging airflow balance, that powder flow between the guns 120, 122 and the bodies 20 to be coated is disturbed. On the other hand, powder which has gotten out as far as the lip region 52 and the vicinity of inlets 66, 68, 70 and 72 is unlikely to land on that part of the bodies 20 which is intended to be coated by the powder. Thus, high velocity scavenging of powder-laden air in this region is desirable to help control deposition of the powder on areas of the bodies 20 which are not desired to be coated, and prevent escape of powder from the coating region generally. It should further be understood that a control mechanism for the dampers could be provided, including individual damper actuators, sensors and, perhaps, even a microprocessor to control dampers 59, 61, 80, 88, 96, 106, 108 and 110 independently, based, for example on the proximity of an article to head 44 or to any one of ducts 66, 68, 70, 72, 100, 102, 104.

The shields 126, 128 are somewhat "clamshell" shaped to enhance the capture of powder which is not desired to be used for coating. The guns 120, 122 are triggered off at the end of a powder dispensing interval, such as occurs when the trailing end of a body 20 passes the respective guns 120, 122. Typically, since the illustrated guns 120, 122 will be at different relative positions longitudinally of a particular body 20 being coated, they will be triggered off at different times. That is, the body 20 being coated will still be in front of one of guns 120, 122 when the body is no longer in front of the other gun 120, 122. Since powder stops being transported through the feed tubing 124 and gun 120 or 122 when the carrier gas supply to the gun is triggered off, any powder remaining in the gun and tubing will simply "lay down" or accumulate in the gun and tubing. That slug of powder will then be picked up at the beginning of the next powder dispensing interval, resulting in a too-rich application of powder at the beginning of the next coating interval. To prevent this, as a body 20 passes by each of guns 120, 122, that gun's respective shield 126, 128 is rotated into its use orientation and a blast of non-powder laden air is supplied to that gun 120, 122 to purge powder from its delivery system. The interiors of the shields 126, 128 are so shaped to deflect the powder thus purged from the respective gun 120, 122 into a respective inlet 102, 104.

When the shields 126, 128 are in the non-use orientations, their external configurations are also such as to deflect scavenging airflow into inlets 102, 104 slightly away from the nozzles of guns 120, 122, thereby reducing the likelihood that scavenging airflow into inlets 102, 104 will disturb the orderly transportation of powder from guns 120, 122 to the body 20 being coated. Additionally, the shields 126, 128 in their non-use orientations lie directly in front of inlets 102, 104, respectively, serving to choke or damp somewhat further the scavenging airflow into these inlets.

What is claimed is:

1. Apparatus for applying a fusible granular precursor of a protective or decorative coating to the surface of an article, the apparatus comprising means for dispensing a stream of the fusible granular precursor in a stream of a bearing fluid, means for recovering fusible granular precursor that does not adhere to the surface of the article, means for mounting the dispensing means within the recovery means and means for coupling the recovery means to means for reclaiming fusible granular precursor recovered by the recovery means, the recovery means including a first manifold, means for establishing in the first manifold a subambient pressure, a second manifold, means for establishing in the second manifold a subambient pressure, means providing a first series of inlets, the inlets of the first series generally surrounding the dispensing means, means for coupling the means providing the first series of inlets to the first manifold, means providing a second series of inlets, and means for coupling the means providing inlets of the second series to the second manifold.

2. The apparatus of claim 1 wherein the means for coupling the means providing inlets of the first series to the first manifold comprises an independently controllable damper for controlling flow through each inlet of the first series.

3. The apparatus of claim 2 wherein the means for coupling the inlets of the second series to the second manifold comprises an independently controllable damper for controlling flow through each inlet of the second series.

4. The apparatus of claim 3 and further comprising a fusible granular precursor deflection shield, means for movably mounting the deflection shield adjacent the dispensing means, and means for selectively moving the deflection shield between a use orientation in which the shield deflects fusible granular precursor dispensed by the dispensing means primarily into one of the inlets of the second series and a storage orientation in which the shield lies between the dispensing means and said one of the inlets of the second series.

5. The apparatus of claim 4 and further comprising second means for dispensing a stream of fusible granular precursor in a stream of a bearing fluid, means for mounting the second dispensing means within the recovery means, a second fusible granular precursor deflection shield, means for movably mounting the second deflection shield adjacent the second dispensing means, and means for selectively moving the second deflection shield between a use orientation in which the second deflection shield deflects fusible granular precursor dispensed by the second dispensing means primarily into a second one of the inlets of the second series and a storage orientation in which the second shield lies between the second dispensing means and said second one of the inlets of the second series.

6. The apparatus of claim 1 wherein the means for coupling the inlets of the second series to the second manifold comprises an independently controllable damper for controlling flow through each inlet of the second series.

7. The apparatus of claim 6 and further comprising a fusible granular precursor deflection shield, means for movably mounting the deflection shield adjacent the dispensing means, and means for selectively moving the deflection shield between a use orientation in which the shield deflects fusible granular precursor dispensed by the dispensing means primarily into one of the inlets of the second series and a storage orientation in which the shield lies between the dispensing means and said one of the inlets of the second series.

8. The apparatus of claim 7 and further comprising second means for dispensing a stream of fusible granular precursor in a stream of a bearing fluid, means for mounting the second dispensing means within the recovery means, a second fusible granular precursor deflection shield, means for movably mounting the second deflection shield adjacent the second dispensing means, and means for selectively moving the second deflection shield between a use orientation in which the second deflection shield deflects fusible granular precursor dispensed by the second dispensing means primarily into a second one of the inlets of the second series and a storage orientation in which the second shield lies between the second dispensing means and said second one of the inlets of the second series.

9. A collection head for collecting dispensed particulate material that does not adhere to an article, at least part of the surface of which is to be coated by the dispensed particulate material, the collection head comprising means for dispensing the particulate material, a first outer shell defining a boundary of the collection head, a second shell lying entirely within the first shell, the second shell including means providing a primary collection duct, the first and second shells cooperating to define between them a secondary collection duct, a first manifold, means for coupling the first manifold to the primary duct, a second manifold, means for coupling the second manifold to the secondary duct, means for coupling the first and second manifolds to means for reclaiming dispensed particulate material that does not adhere to the article, and means for independently controlling flow through the first and second ducts.

10. The apparatus of claim 9 wherein the first outer shell includes means defining a lip region having a first contour, the surface of the article having a second contour, the first contour generally conforming to a portion, but less than all, of the second contour.

11. The apparatus of claim 10 including means providing a plurality of primary collection ducts.

12. The apparatus of claim 11 including means for independently controlling flow through each of the primary collection ducts.

13. The apparatus of claim 10 including means providing a plurality of secondary collection ducts.

14. The apparatus of claim 13 including means for independently controlling flow through each of the secondary collection ducts.

15. The apparatus of claim 10 and further comprising a particulate material deflection shield, means for movably mounting the deflection shield adjacent the dispensing means, and means for selectively moving the deflection shield between a use orientation in which the shield deflects particulate material dispensed by the dispensing means primarily into the primary collection duct and a storage orientation in which the shield lies between the dispensing means and the primary collection duct.

* * * * *